US006651356B1

(12) United States Patent
Buehring

(10) Patent No.: US 6,651,356 B1
(45) Date of Patent: Nov. 25, 2003

(54) AIR IONIZING DRYING APPARATUS

(76) Inventor: Alice C. Buehring, 2415 136th Pl. SW., Lynnwood, WA (US) 98037

( * ) Notice: Subject to any disclaimer, the term of this patent is extended or adjusted under 35 U.S.C. 154(b) by 0 days.

(21) Appl. No.: 10/236,173

(22) Filed: Sep. 6, 2002

(51) Int. Cl.[7] ..... F26B 3/34

(52) U.S. Cl. ..... 34/254; 34/529; 34/90; 34/232; 422/22

(58) Field of Search ..... 34/524, 526, 529, 34/530, 543, 546, 549, 553, 554, 90, 218, 232, 250, 254; 422/22, 29, 186.04

(56) References Cited

U.S. PATENT DOCUMENTS

| | | | | |
|---|---|---|---|---|
| 2,714,151 A | | 7/1955 | Becker | |
| 3,621,199 A | | 11/1971 | Goldstein | |
| 3,878,621 A | | 4/1975 | Duerre | |
| 3,945,432 A | * | 3/1976 | Tamblyn | 165/210 |
| 4,383,377 A | | 5/1983 | Crafton | |
| D285,602 S | | 9/1986 | Warshaw et al. | |
| 4,756,094 A | | 7/1988 | Houck, Jr. | |
| 5,007,182 A | | 4/1991 | Fishman et al. | |
| 5,010,777 A | * | 4/1991 | Yehl et al. | 73/864.81 |
| 5,031,337 A | * | 7/1991 | Pilolla et al. | 34/526 |
| 5,074,322 A | | 12/1991 | Jaw | |
| 5,099,587 A | * | 3/1992 | Jarosch | 34/202 |
| 5,269,071 A | | 12/1993 | Hamabe et al. | |
| 5,428,964 A | * | 7/1995 | Lobdell | 62/176.6 |
| 5,438,763 A | | 8/1995 | Yang | |
| 5,459,944 A | * | 10/1995 | Tatsutani et al. | 190/18 R |
| 5,651,189 A | * | 7/1997 | Coykendall et al. | 34/90 |
| D382,950 S | | 8/1997 | Kruger | |
| 5,873,179 A | * | 2/1999 | Gregory et al. | 34/90 |
| 5,930,912 A | | 8/1999 | Carder | |
| 6,038,786 A | * | 3/2000 | Aisenberg et al. | 34/267 |
| 6,393,718 B1 | * | 5/2002 | Harris et al. | 34/96 |
| 2003/0072675 A1 | * | 4/2003 | Takeda et al. | 422/22 |

* cited by examiner

*Primary Examiner*—Ira S. Lazarus
*Assistant Examiner*—Andrea M. Ragonese

(57) ABSTRACT

An air ionizing drying includes an elongated housing that has an interior, an inlet opening, and an elongated outlet opening. A microcontroller is positioned in the interior of the housing. A control panel is coupled to the housing and operationally coupled to the microcontroller. An intake conduit is positioned in the housing and extends from the intake opening. A heating assembly is positioned in the interior of the housing for receiving air passing through the intake conduit. The heating assembly is operationally coupled to the microcontroller. A manifold is environmentally coupled to the heating assembly for receiving air passing through the heating assembly. A fan assembly has a plurality of fans and is coupled to the manifold for drawing air through the manifold. An outlet conduit extends between the fan assembly and the outlet opening. An ionizing assembly is coupled to the outlet conduit for ionizing air passing through the outlet conduit.

14 Claims, 4 Drawing Sheets

AIR IONIZING DRYING APPARATUS

BACKGROUND OF THE INVENTION

1. Field of the Invention

The present invention relates to blown hot air dryers and more particularly pertains to a new air ionizing drying apparatus for drying a body or part of a body with ionized air flow to promote health.

2. Description of the Prior Art

The use of blown hot air dryers is known in the prior art. U.S. Pat. No. 3,878,621 describes a multi-nozzle device for drying selected parts of the body. Another type of blown hot air dryer is U.S. Pat. No. 5,269,071 discloses a pivotally mounted blower with reciprocating motion. U.S. Pat. No. 5,930,912 discloses a portable multi-nozzle collapsible device. U.S. Pat. No. 5,007,182 discloses a pedestal type dryer for supporting and drying a person. U.S. Pat. No. 3,621,199 discloses an oscillated deflector to direct an air stream upwards and downwards over a body. U.S. Pat. No. 4,756,094 discloses an elongated air distribution chamber connectable to a blown air source. U.S. Pat. No. 4,383,377 discloses a conventional blown air hand dryer incorporating a deodorizing element. U.S. Pat. No. 5,074,322 discloses a housing forming a sterilizing chamber to spray a solution and dry hands inserted into the sterilizing chamber. U.S. Pat. No. 2,714,151 discloses a conventionally known blown air hand dryer with a visual indicator. U.S. Pat. No. 5,438,763 discloses a blown air hand dryer with an attached hose to permit hair drying. U.S. Pat. No. Des. 285,602 and U.S. Pat. No. Des. 382,950 each show an ornamental design for a blow dryer.

While these devices fulfill their respective, particular objectives and requirements, the need remains for a device that ionizes air used to dry the body.

SUMMARY OF THE INVENTION

The present invention meets the needs presented above by providing a device that ionizes air that is heated and blown out of a housing that is mountable to a support structure.

Still yet another object of the present invention is to provide a new air ionizing drying apparatus that provides a wide stream of air to permit drying of the entire body using heated ionized air flow.

Even still another object of the present invention is to provide a new air ionizing drying apparatus that permits enhanced control over the flow of air by permitting manual or automatic shutdown after a pre-determined time period, adjustable temperature, adjustable air flow speed, automatic starting using sensors, and lockout features to prevent unauthorized use.

To this end, the present invention generally comprises an elongated housing that has an interior, an inlet opening, and an elongated outlet opening. A microcontroller is positioned in the interior of the housing. A control panel is coupled to the housing and is operationally coupled to the microcontroller. An intake conduit is positioned in the housing and extends from the intake opening. A heating assembly positioned in the interior of the housing is for receiving air passing through the intake conduit. The heating assembly is operationally coupled to the microcontroller. A manifold is environmentally coupled to the heating assembly for receiving air passing through the heating assembly. A fan assembly has a plurality of fans, the fan assembly is coupled to the manifold for drawing air through the manifold. An outlet conduit extends between the fan assembly and the outlet opening. An ionizing assembly is coupled to the outlet conduit for ionizing air passing through the outlet conduit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
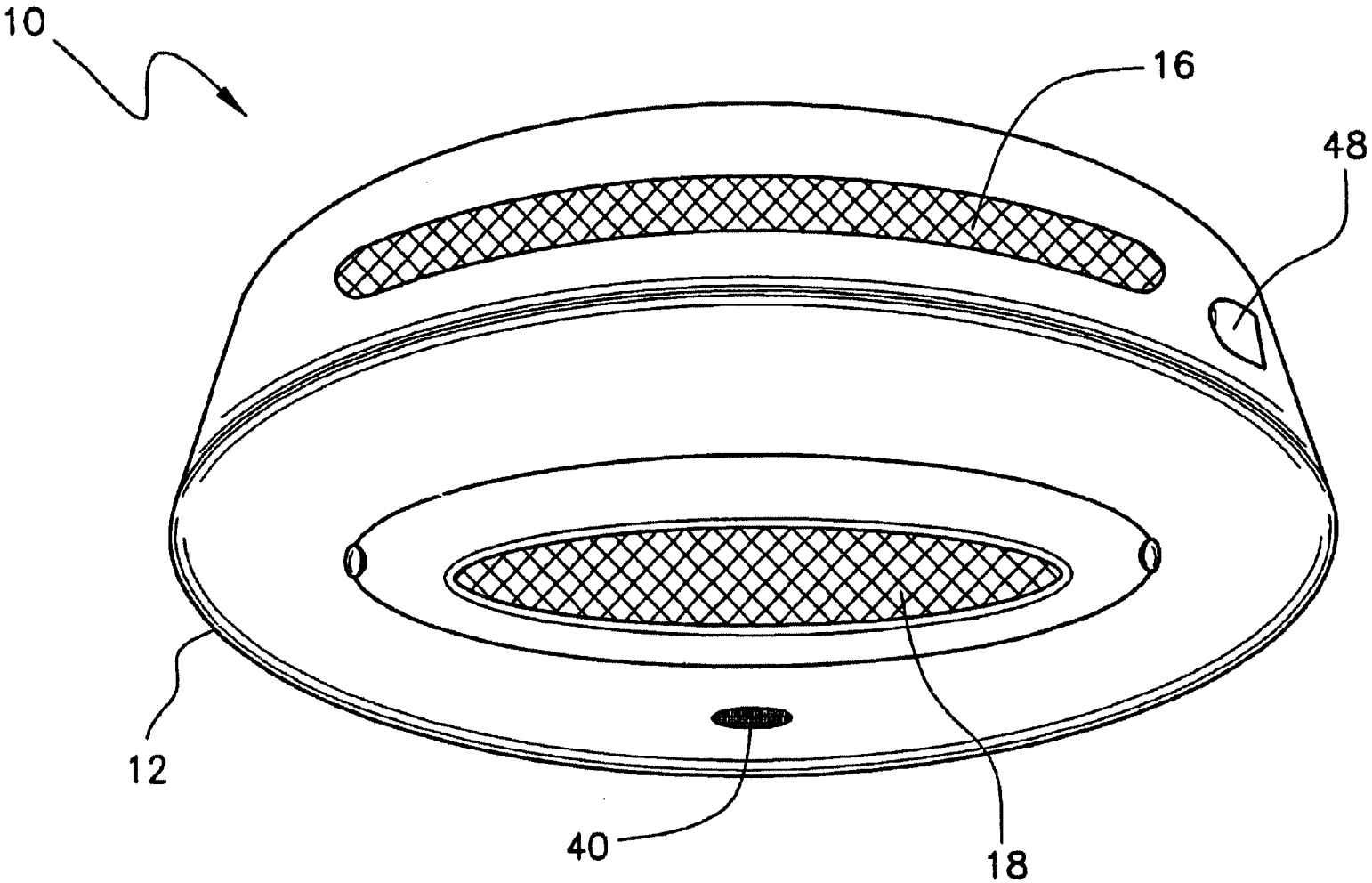
FIG. 1 is a perspective view of a new air ionizing drying apparatus according to the present invention.
Figure 2:
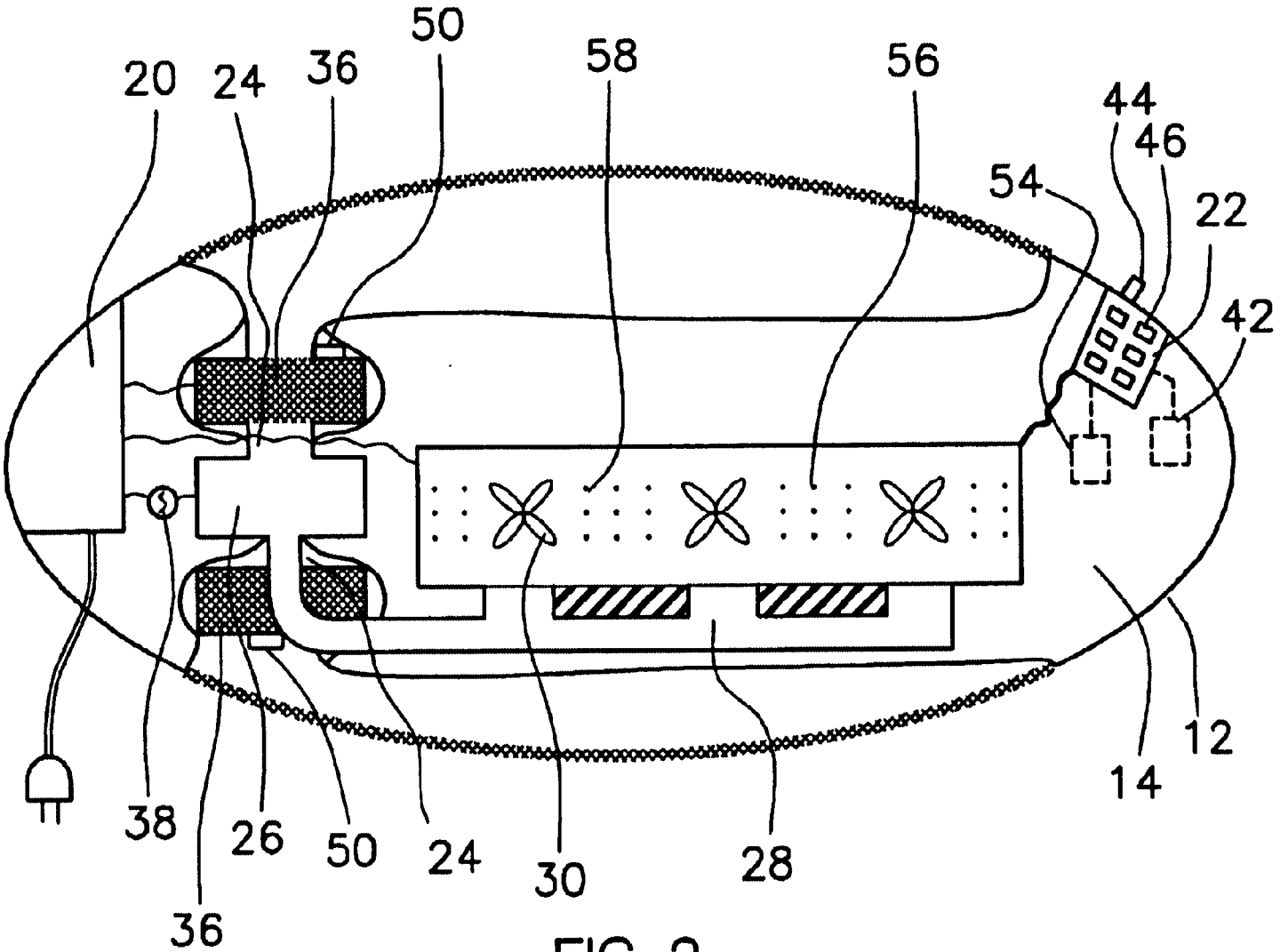
FIG. 2 is a cross-sectional view of the present invention.
Figure 3:
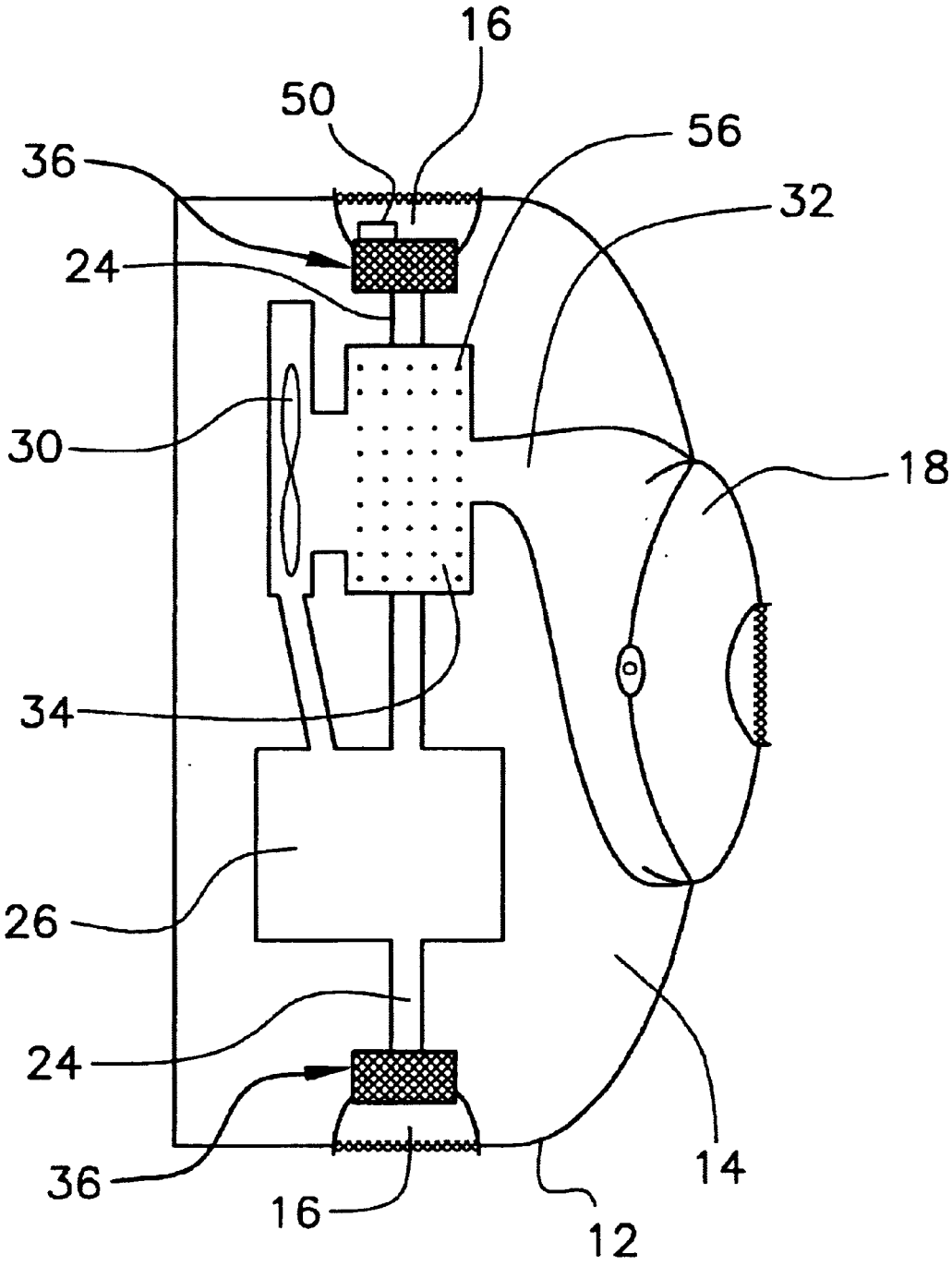
FIG. 3 is a cross-sectional view of the present invention.
Figure 4:
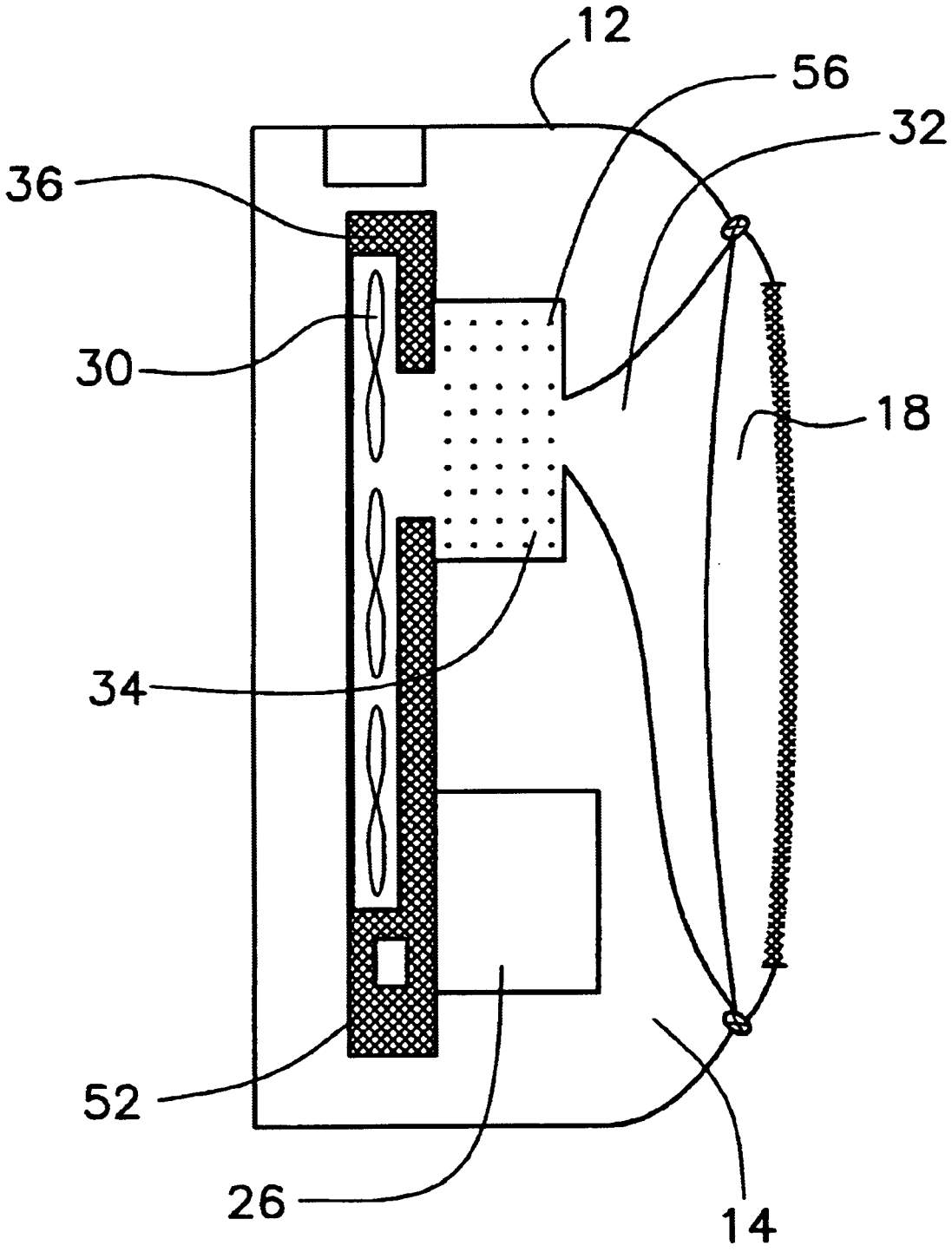
FIG. 4 is a cross-sectional view of the present invention.

With reference now to the drawings, and in particular to FIGS. 1 through 3 thereof, a new air ionizing drying apparatus embodying the principles and concepts of the present invention and generally designated by the reference numeral 10 will be described.

As best illustrated in FIGS. 1 through 3, the air ionizing drying apparatus 10 generally comprises an elongated housing 12 that has an interior 14, an inlet opening 16, and an elongated outlet opening 18. A microcontroller 20 is positioned in the interior of the housing 12. A control panel 22 is coupled to the housing 12 and is operationally coupled to the microcontroller 20. An intake conduit 24 is positioned in the housing 12 and extends from the intake opening 16. A pair of such air intake conduits may be used, one positioned on each side of the housing 12. A heating assembly 26 is positioned in the interior of the housing 12 and is for receiving air passing through the intake conduit 24. The heating assembly 26 is operationally coupled to the microcontroller 20. A manifold 28 is environmentally coupled to the heating assembly 26 for receiving air passing through the heating assembly 26. A fan assembly 30 has a plurality of fans. The fan assembly 30 is coupled to the manifold 28 for drawing air through the manifold 28. An outlet conduit 32 extends between the fan assembly 30 and the outlet opening 18. A nozzle is positioned in the outlet conduit for directing outflow of air in a desired direction. An ionizing assembly 34 is coupled to the outlet conduit 32 for ionizing air passing through the outlet conduit 32.

The fan assembly 30 is elongated and substantially aligned with the elongated outlet opening 18. The fans are positioned side by side along a length of the fan assembly 30 for passing air evenly through the fan assembly 30 into the outlet conduit 32.

An air filtering assembly 36 is coupled to the air intake conduit 24 for filtering air drawn into and through the air intake conduit 24. Typically, screens cover the air intake conduits and may be removed to facilitate cleaning of the screens and to provide access to the air filtering assembly to permit replacement of filters in the air filtering assembly.

A thermostat 38 is operationally coupled to the heating assembly 26. The thermostat 38 further is operationally coupled to the microcontroller 20 for permitting adjustment of a temperature of air passed out of the heating assembly 26 using the control panel 22. A sensor 40 is coupled to the housing 12. The sensor 40 is for detecting an object adjacent the elongated outlet opening 18. The sensor 40 is operationally coupled to the microcontroller 20 whereby the microcontroller 20 activates the drying apparatus 10 when the sensor 40 detects the object adjacent the elongated outlet opening 18.

A timer 42 is operationally coupled to the microcontroller 20 for permitting automatic deactivation of the drying apparatus 10 a pre-determined time period after activation of the drying apparatus 10. The control panel 22 includes input means for inputting the pre-determined time period.

A power switch 44 is positioned on the control panel 22 and operationally coupled to the microcontroller 20 for permitting manual activation and deactivation of the drying apparatus 19.

The control panel 22 includes an input means 46 for inputting a password. Optionally, the microcontroller 20 activates the drying apparatus 10 only after inputting of the password to prevent unauthorized use. The password may also be used to permit changing of settings including but not limited to choice of temperature, strength of air flow, manual or automatic activation, duration of use before deactivation, manual or automatic deactivation, and activate or deactivate the heating element.

A panel lid 48 is coupled to the housing 12 for selectively covering the control panel 22. The panel lid 48 is openable to provide access to the control panel 22.

The microcontroller 20 is operationally coupled to the fan assembly 30 for permitting adjustment of flow of air through the fan assembly 30.

The air filtering assembly 36 includes a filter monitor 50 for detecting air flow through the filter 52. The air filtering assembly includes an alarm 54 that is operationally coupled to the filter monitor 50 for providing an alarm signal when flow through the air filters 52 falls below a pre-determined level. Additionally, the microcontroller is operationally coupled to the filter monitor 50 to automatically shut off the air ionizing apparatus 10 upon the filter monitor 50 detecting flow through the air filter 52 falling below a pre-determined level.

A high voltage (but at extremely limited current, for safety) is applied to one or more needles 56. Electricity is a flow of individual electrons. And these electrons, supplied by the internal circuit, are pushed down the needle 56 towards the point 58. The nearer they get to the point 58, the closer they become forced together. Electrons naturally repell each other, so as they reach the tip, the pressure becomes too much and they "jump" off, onto the nearest air molecule, turning it into an ion.

Negative ions again repel each other, so they are driven from the needles 56 as a gentle breeze, forming a dense "cloud" in front of the drying apparatus, which disperses in all directions into the room.

In use, the present invention can be installed in a bathroom or kitchen in either a horizontal or vertical orientation. The present invention could be activated manually or by motion. The user would then dry him or her self with the warm ionized air emitted by the unit. A longer slimmer design is possible using more aligned fans to accommodate drying an entire body when the air outlet is oriented vertically. It is also contemplated that a portable model is possible using a self-contained power source in place of an electrical cord.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air ionizing drying apparatus comprising:

an elongated housing having an interior, an inlet opening, and an elongated outlet opening;

a microcontroller positioned in said interior of said housing;

a control panel coupled to said housing and operationally coupled to said microcontroller;

an intake conduit positioned in said housing and extending from said intake opening;

a heating assembly positioned in said interior of said housing for receiving air passing through said intake conduit, said heating assembly being operationally coupled to said microcontroller;

a manifold environmentally coupled to said heating assembly for receiving air passing through said heating assembly;

a fan assembly having a plurality of fans, said fan assembly being coupled to said manifold for drawing air through said manifold;

an outlet conduit extending between said fan assembly and said outlet opening; and an ionizing assembly coupled to said outlet conduit for ionizing air passing through said outlet conduit.

2. The air ionizing drying apparatus of claim 1, further comprising:

said fan assembly being elongated and substantially aligned with said elongated outlet opening, said fans being positioned side by side along a length of said fan assembly for passing air evenly through said fan assembly into said outlet conduit.

3. The air ionizing drying apparatus of claim 1, further comprising:

an air filtering assembly coupled to said air intake conduit for filtering air drawn into and through said air intake conduit.

4. The air ionizing drying apparatus of claim 1, further comprising:

a thermostat operationally coupled to said heating assembly, said thermostat further being operationally coupled to said microcontroller for permitting adjustment of a temperature of air passed out of said heating assembly using said control panel.

5. The air ionizing drying apparatus of claim 2, further comprising:

a sensor coupled to said housing, said sensor being used for detecting an object adjacent said elongated outlet opening, said sensor being operationally coupled to said microcontroller whereby said microcontroller activates said drying apparatus when said sensor detects the object adjacent said elongated outlet opening.

6. The air ionizing drying apparatus of claim 2, further comprising:

a timer operationally coupled to said microcontroller for permitting automatic deactivation of said drying apparatus a pre-determined time period after activation of said drying apparatus.

7. The air ionizing drying apparatus of claim 6, further comprising:

said control panel including input means for inputting said pre-determined time period.

8. The air ionizing drying apparatus of claim 1, further comprising:

a power switch positioned on said control panel and operationally coupled to said microcontroller for permitting manual activation and deactivation of said drying apparatus.

9. The air ionizing drying apparatus of claim 1, further comprising:

said control panel including input means for inputting a password, said microcontroller activating said drying apparatus only after inputting of said password to prevent unauthorized use.

10. The air ionizing drying apparatus of claim 1, further comprising:

a panel lid coupled to said housing for selectively covering said control panel, said panel lid being openable to provide access to said control panel.

11. The air ionizing drying apparatus of claim 1, further comprising:

said microcontroller being operationally coupled to said fan assembly for permitting adjustment of flow of air through said fan assembly.

12. The air ionizing drying apparatus of claim 3, further comprising:

said air filtering assembly including a filter monitor for detecting air flow through said filter; and said air filtering assembly including an alarm operationally coupled to said filter monitor for providing an alarm signal when flow through said air filter falls below a pre-determined level.

13. The air ionizing drying apparatus of claim 12 wherein said micrcontroller is operationally coupled to said filter monitor to automatically shut off said air ionizing apparatus upon said filter monitor detecting flow through said air filter falling below said pre-determined level.

14. The air ionizing drying apparatus of claim 1, further comprising:

said ionizing assembly comprising a plurality of needles and a high voltage provided to said plurality of needles for forming an electron cloud to ionize air passing through said ionizing assembly.

* * * * *